United States Patent [19]

Appleman

[11] 4,118,887

[45] Oct. 10, 1978

[54] TAKE-APART FIGURE TOY

[76] Inventor: Donald T. Appleman, 878 Wismar Dr., Cincinnati, Ohio 45230

[21] Appl. No.: 747,200

[22] Filed: Dec. 3, 1976

[51] Int. Cl.[2] ..... A63H 33/04

[52] U.S. Cl. ..... 46/22; 46/30

[58] Field of Search ..... 46/17, 22, 30, 31, 25, 46/26

[56] References Cited

U.S. PATENT DOCUMENTS

| | | | |
|---|---|---|---|
| 1,182,055 | 5/1916 | Thom | 46/22 |
| 1,281,492 | 10/1918 | Blamfield | 46/22 |
| 1,368,917 | 2/1921 | Fithian | 46/22 |
| 1,370,303 | 3/1921 | Gillespie | 46/22 |
| 1,649,135 | 11/1927 | Shasteen | 46/22 |
| 2,338,738 | 1/1944 | Rebholz | 46/22 |
| 2,739,414 | 3/1956 | Cleveland | 46/17 |
| 3,564,758 | 2/1971 | Willis | 46/31 |
| 3,827,177 | 8/1974 | Wengel | 46/31 |

FOREIGN PATENT DOCUMENTS

| | | | |
|---|---|---|---|
| 1,002,582 | 11/1951 | France | 46/22 |
| 377,258 | 6/1964 | Switzerland | 46/31 |

*Primary Examiner*—F. Barry Shay

*Attorney, Agent, or Firm*—Wood, Herron & Evans

[57] ABSTRACT

A take-apart toy includes a universal flat body and a set of appendages for forming a toy, such as a geometrical shape, building member ornament, or figure. The body is provided with elongated grooves on each side, uniformly spaced from the body's edge. Each appendage includes a body receiving slot having groove-engaging lugs at an outer end for engaging the grooves and releasably securing appendage to body. The elongated grooves permit selective movement and positioning of the appendages around the body without disengaging the lugs from the grooves. The appendage slots are longer than the distance between the grooves and the body edge to permit angular adjustment of the appendages on the body, also without removal of the lugs from the grooves. Selected appendages are also provided with similar elongated grooves for attachment of other slotted appendages thereto.

13 Claims, 5 Drawing Figures

TAKE-APART FIGURE TOY

This invention relates to take-apart toys and particularly to structure relating to the connection of one toy member to another.

In the past, various devices have been designed for connecting one toy part to another. For example, U.S. Pat. No. 3,564,758, disclosed slotted structures for assembling toys wherein each member to be joined includes a slot having teeth for engaging a hole in an adjoining slotted member. The structure disclosed in the patent perhaps results in a rather solid joint, however, once the pieces are joined they are relatively immovable. Thus, the various pieces can only be joined to each other in a set position which is predetermined by the slotted structure of each piece. In other words, it is only possible to assemble one piece to another in certain predetermined patterns.

Accordingly, one objective of this invention has been to provide improved means for securing one toy member to another.

A further objective of the present invention has been to provide an improved toy including a body member and a plurality of appendages which can be positively but releasably secured thereto in a manner which permits movement of the appendage around the body and at a different angular relationships thereto, all without disengaging the appendage.

A still further objective of the invention has been to provide an improved toy including a universal body member and different sets of appendages which can be releasably secured thereto, in a variety of positions and angles, to provide varying toys which include geometrical shapes, ornaments, building members or figures, all based on the same body.

To these ends, a preferred embodiment of the invention includes a thin, generally elongated universal body having two flat sides with continuous grooves on each side, each groove uniformly spaced from the body's smooth edge. Appendages have body receiving slots therein with opposing projections located at the outer slot ends and extending into the slots. The appendage slot depth is slightly longer than the distance from the groove to the body edge of the body and the appendage's slot width is approximately equal to the body's thickness.

With the improved construction, the parts cooperate to function in a highly improved and novel manner not realized in prior structures. Each appendage can be moved completely around the body without disengagement of the projections from the grooves. Also, due to slight elongation of the slot, the appendages can be angularly adjusted with respect to the body and without first disengaging the projections from the grooves. Different sets of appendages are provided to permit construction of many different toys such as geometrical shapes, building members, ornaments and figures such as clowns or animals. In a further aspect of the invention, intermediate appendages are additionally provided with their own grooves to permit connection of other appendages thereto in the same manner that appendages are attached to the body.

Accordingly, it shall be appreciated that the invention provides significantly improved connection apparatus for toy parts which provides novel appendage movement and permits a single universal body to be used vertically or horizontally as a base for many different toys, depending on the set of appendages used.

These and other advantages will become readily apparent from the following detailed description of a preferred embodiment of the invention and from the drawings in which.

Figure 1:
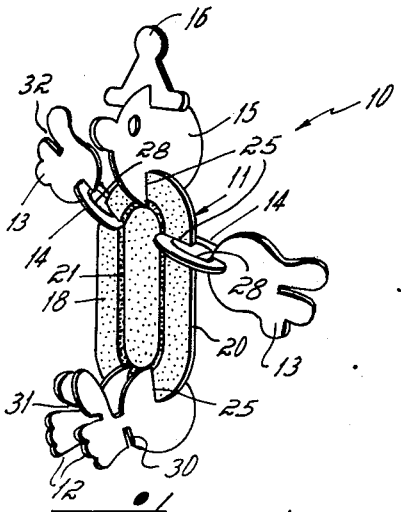
FIG. 1 is a perspective view of a toy clown in accordance with a preferred embodiment of the invention.

Turning now to the drawings, there is shown in FIG. 1 a preferred embodiment of a toy according to the invention and including a clown toy 10. The clown toy 10 is shown simply to illustrate the invention and it shall be appreciated that the inventionis equally applicable to other forms of toys such as, for example, geometrical shapes, building members, ornaments or figures such as simulated humans, animals or decorative designs.

The toy 10 includes a universal body member 11 and a plurality of appendages. In FIG. 1, there are two foot appendages 12, two hand appendages 13, and two intermediate arm appendages 14. Further, there is a head appendage 15 and a hat appendage 16. All of the appendages 12–16, together with the universal body 11, constitute a clown toy.

In another embodiment, for example, the appendages could be designed to present the appearance of another toy, such as a giraffe for example, in which case the appendages would differ in design to present a giraffe-like caricature. These can be assembled using universal body 11 as a base.

Figure 3:
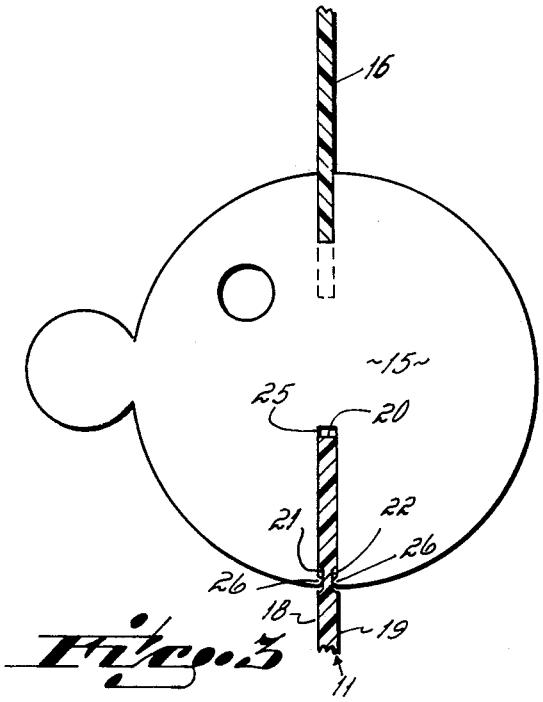
FIG. 3 is a cross-sectional view taken along lines 3—3 of FIG. 2.
Figure 4:
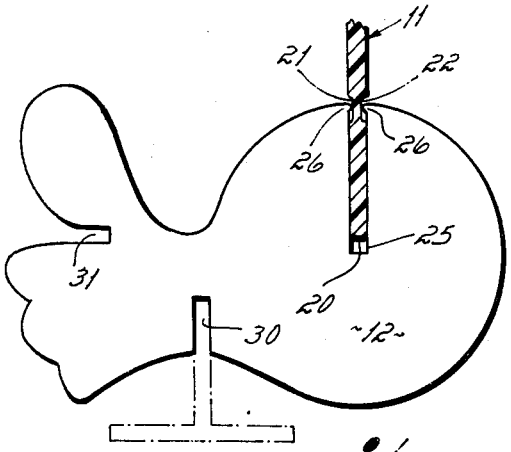
FIG. 4 is a cross-sectional view taken along lines 4—4 of FIG. 2.

As shown in the drawing, the body 11 is, in shape, elongated and has rounded ends. The body comprises two essentially flat sides 18 and 19 which terminate in a relatively smooth edge 20. Each side of the body is provided with a groove. In this embodiment, groove 21 is provided on the front side of the body and the groove 22 is on the rear side of the body. As shown, the grooves are preferrably continuous and are uniformly spaced from the edge of the body 11. The grooves on each side of the body register with the grooves on the other side so that the body thickness between the grooves, as shown for example, in FIGS. 3 and 4, is less than the ungrooved body width.

Each of the appendages is provided with a body receiving slot 25, and each of the slots is provided at its outermost end, adjacent the edge of the appendage, with opposing projections such as lugs or teeth 26 which extend inwardly into the slot. The lugs 26 are spaced apart a distance approximately equal to the thickness of the body 11 between the grooves 21 and 22.

Each of the slots is approximately as wide as the body is thick so that the appendages are slidable on the body, but in the absence of purposeful movement tend to remain in position, being held by friction.

Figure 5:
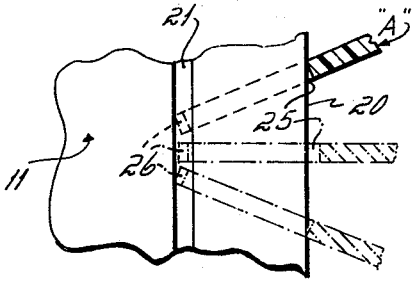
FIG. 5 is an illustrative view showing the angularly adjustable relationship of appendage to body.

Each of the slots has a length which is approximately equal to and preferably slightly longer than the distance between the grooves on the body 11 and the smooth body edge 20. This relationship can be particularly seen in FIGS. 3, 4 and 5. More particularly, and in FIG. 4, for example, the slot 25 is long enough so that the edge of the body 11 does not engage the bottom of the slot in the appendage 12 when the apendage's lugs 26 are placed in the body grooves. Accordingly, the appendage 12 can be pivoted generally about the lugs 26 so that the appendage 12 is angularly adjustable with respect to the body without withdrawing the lugs from the grooves. The angular adjustment range is illustrated in FIG. 5 wherein it is illustrated that an appendage "A" can be angularly adjusted throughout a substantial angular range in order to provide variable appendage positions on the body.

Figure 2:
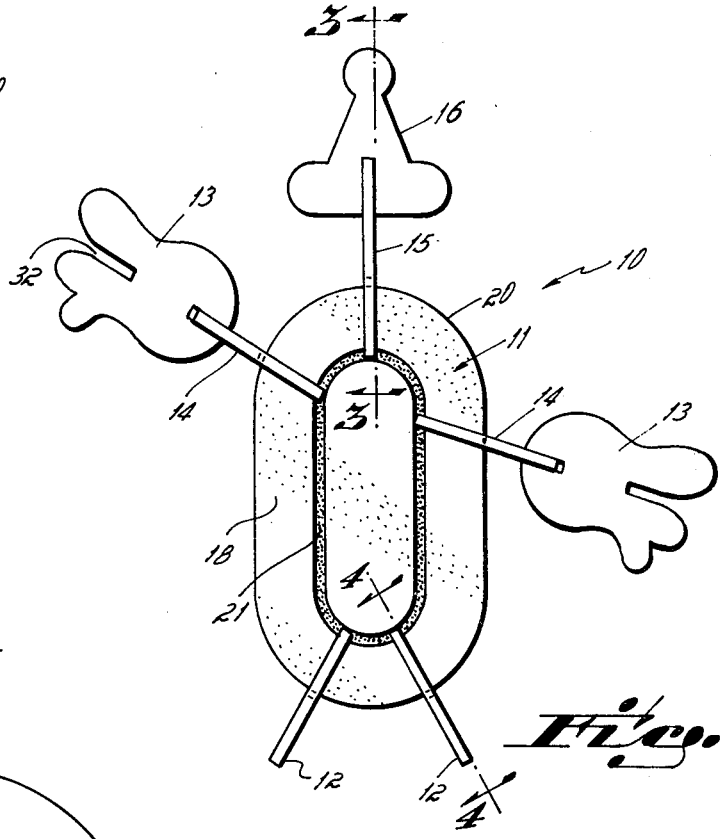
FIG. 2 is a front view of the toy of FIG. 1.

In addition, it shall be appreciated that each of the appendages is movable completely about the body member 11 without disengaging the lugs from the grooves 21 and 22. Accordingly, and for example, the body member can be used in an upright/vertical fashion, as shown in FIGS. 1 and 2, in order to provide an upright base for a clown, for example. Alternately, the body can be disposed horizontally when it is desired to use differently designed appendages to form figures such as an animal having an elongated body.

In another aspect of the invention, selected appendages can also be provided with their own grooves to permit the connection of further appendages thereon. In FIG. 1, for example, intermediate arm appendages 14 are each provided with a slot and lug projections for engaging the grooves on the body 11. Additionally, however, arm appendages 14 are provided with their own continuous grooves 28, on each side thereof. This permits the connection of the hand appendages 13 to the intermediate appendages 14 by virtue of the grooves 28 and the slot and lug construction of appendage 13. The hand appendages are movable around the intermediate appendages to provide different forms or configurations.

The appendages can also be provided with further slots to permit their connection to the appendages of other toys. For example, in FIG. 4, the appendage 12 is provided with a slot 30 for receiving a projection of a stand member shown in the phantom lines in FIG. 4. Alternately, the foot appendage 12 of the clown, as shown in FIG. 1, can be engaged with the hand appendage of another clown toy to provide a stacking or pyramiding effect, or any other desired connections.

In addition, a slot 31 is also included in the foot appendages 12 to permit connection of the foot to different portions of another toy. Likewise, slots 32 are provided in the hand appendages to permit connection of the hand appendages to portions of other toys.

Accordingly, it should be appreciated that the invention provides improved means for connecting one toy member to another. The invention permits the use of a universal body with a plurality of different appendages which are provided with the slot and lug structure as described above. The structure permits a secure construction of appendage to body member, and also permits the apendages to be moved completely around the body member and to be angularly adjusted to provide different appendage positions on the body member, all without disengaging the appendage from the body.

These and other advantages and modifications will become readily apparent to one of ordinary skill in the art without departing from the scope of this invention. For example, in place of the double slotted connection in the appendage 16 to the appendage 15 (each of the appendages simply being slotted to accommodate each other), the head could be provided with a groove on each side, the grooves being uniformly spaced from the edge of head 15. The slots in the hat appendage 16 could be provided with lugs for engaging the head grooves in order to permit different angular relationships and movements of the hat 16 with respect to the head 15. Also, slot width can be varied to adjust the force needed to move the appendages around the body. Further, one groove and corresponding lug could be eliminated. Thus, variations in appendage designs will be readily appreciated from this disclosure and applicant intends to be bound only by the claims appended hereto.

I claim:

1. A toy comprising:

a universal body having two opposite flat sides terminating in a thin portion adjacent an edge of said body, an elonated groove on each of said sides, said grooves uniformly spaced from said edge, appendage means for connection to said body, said appendage means having a thin portion adjacent an edge of said appendage means, said latter thin portion having a body receiving slot therein extending inwardly from an edge of said appendage means and including projection means extending into said slot from said side thereof to engage said grooves when said body is received in said slot, said projection means disposed adjacent the outer end of said slot and engging in respective ones of said grooves on each side of said body when said body is received in said slot, said slot having a length longer than the distance between the grooves and the body edge wherein the connection between said body and appendage means is such as to permit said appendage means to pivot about said projection means without disengagement of said projection means from said grooves, and said grooves extending along said sides a predetermined distance to permit said appendage means to move along said body edge without removing said projection means from said grooves.

2. A toy as in claim 1 wherein said slot has a width approximately equal to the thickness of said body.

3. A toy as in claim 2 wherein said projection means comprises opposing lugs extending into said slot, the distance between said opposing lugs being less than the thickness of said body.

4. A toy as in claim 3 wherein said slots on each side of said body are in register and wherein said body, between said grooves, has a predetermined thickness less than the thickness of the remainder of the body, the distance between said lugs being approximately equal to said predetermined thickness.

5. A toy as in claim 4 wherein said appendage means are sufficiently yieldable to permit said lugs to be manually pushed onto said body and into said grooves.

6. A toy as in claim 1 including at least one additional slot in selected appendage means to permit appendage means of one toy to be connected to appendage means of another toy.

7. A toy as in claim 1 including a first set of a plurality of appendage means forming, in combination with said body, a predetermined toy having multiple adjustable appendages releasably attached to said body.

8. A toy as in claim 1 including at least two sets of appendage means, one set of appendage means forming, in connection with said body, a different toy than that to be formed by said body and said other set of appendage means.

9. A toy as in claim 1 wherein said appendage means are provided with an elongate groove parallel to the edge thereof and including other appendage means connected thereto.

10. A toy as in claim 9 wherein said other appendage means are also provided with a receiving slot extending inwardly from an appendage means edge and having groove engaging projection means extending therein from each side thereof.

11. A toy as in claim 1 wherein the groove on each respective side of said body is a single continuous groove.

12. A toy as in claim 1 wherein said body is elongated and has rounded ends.

13. A toy comprising:

a universal body having two opposite flat sides terminating in a thin portion adjacent an edge of said body, an elongated continuous groove on each of said sides, said grooves being uniformly spaced from said body edge, and said grooves being in register with each other, appendage means for connection to said body, said appendage means having a thin portion adjacent an edge of said appendage means, said latter thin portion having a body receiving slot therein extending inwardly from an edge of said appendage means and including projection means extending into said slot from each side thereof to engage said grooves when said body is received in said slot, said projection means being disposed adjacent the outer end of said slot proximate the edge of said appendage means and engaging respective grooves on each side of said body when said body is received in said slot, and said slot having a length greater than the distance between said respective grooves and the body edge, wherein the connection between said body and appendage means is such as to both permit said appendage means to move along said body edge and to permit said appendage means to be angularly adjusted about said projection means and with respect to said body without removing said projection means from said grooves.

* * * * *

UNITED STATES PATENT AND TRADEMARK OFFICE

CERTIFICATE OF CORRECTION

PATENT NO. : 4,118,887

DATED : October 10, 1978

INVENTOR(S) : Donald T. Appleman

It is certified that error appears in the above-identified patent and that said Letters Patent are hereby corrected as shown below:

Column 1, line 9, "disclosed" should be --discloses--

Column 1, line 13, "the" should be --that--

Column 1, line 28, delete "a"

Column 2, line 20, "inventionis" should be --invention is--

Column 4, line 22, "said" should be --each--

Column 4, line 25 "engging" should be --engaging--

Column 4, line 68 "elongate" should be --elongated--

Signed and Sealed this

*Fifth* Day of *June 1979*

[SEAL]

*Attest:*

RUTH C. MASON
*Attesting Officer*

DONALD W. BANNER
*Commissioner of Patents and Trademarks*